US006145831A

United States Patent [19]

Inoue et al.

[11] Patent Number: 6,145,831

[45] Date of Patent: Nov. 14, 2000

[54] SHEET FEEDER CAPABLE OF ELIMINATING OVERLAPPING SHEET FEED

[75] Inventors: Mitsuaki Inoue, Tsu; Kazumasa Makino, Nagoya; Tetsuo Asada, Kuwana, all of Japan

[73] Assignee: Brother Kogyo Kabushiki Kaisha, Nagoya, Japan

[21] Appl. No.: 09/138,096

[22] Filed: Aug. 21, 1998

[30] Foreign Application Priority Data

Aug. 25, 1997 [JP] Japan ..... 9-227782

[51] Int. Cl.[7] ..... B65H 3/52

[52] U.S. Cl. ..... 271/121; 271/124

[58] Field of Search ..... 271/121, 124

[56] References Cited

U.S. PATENT DOCUMENTS

| | | | |
|---|---|---|---|
| 5,104,113 | 4/1992 | Kameyama et al. | 271/124 |
| 5,244,191 | 9/1993 | Kanekura | 271/124 |
| 5,372,359 | 12/1994 | Miura et al. | 271/121 |
| 5,374,047 | 12/1994 | Tsukamoto et al. | 271/121 |
| 5,584,475 | 12/1996 | Asada et al. | 271/121 |
| 5,655,762 | 8/1997 | Yergenson | 271/121 |
| 5,863,036 | 1/1999 | Tanaka et al. | 271/121 |
| 5,934,664 | 8/1999 | Murayama et al. | 271/121 |
| 5,996,989 | 12/1999 | Cahill et al. | 271/121 |
| 5,997,198 | 12/1999 | Murayama et al. | 271/121 |

*Primary Examiner*—Donald P. Walsh
*Assistant Examiner*—Brett C. Martin
*Attorney, Agent, or Firm*—Oliff & Berridge, PLC

[57] ABSTRACT

A sheet feeder provided in an image forming device and includes a sheet feed roller, a pair of rollers provided at both ends of the sheet feed roller and rotatable independent of the sheet feed roller, and a separation pad provided in confronting relation to the sheet feed roller and the pair of rollers. The sheet feed roller has a circumferential surface portion and a cut-out surface portion. When the cut-out surface portion is opposite a sheet and the separating pad, outer peripheral surface portions of the pair of rollers contact the sheet at approximately the same level position that the circumferential surface portion of the feed roller contacts the sheet. This maintains the separating pad in approximately the same position.

22 Claims, 6 Drawing Sheets

SHEET FEEDER CAPABLE OF ELIMINATING OVERLAPPING SHEET FEED

BACKGROUND OF THE INVENTION

The present invention relates to a sheet feeder provided in an image forming device such as a copy machine, laser printer, and facsimile machine, and more particularly, to a sheet feeder for feeding stacked sheets of a recording medium one sheet at a time.

A conventional sheet feeding device provided in image forming devices such as copy machines, laser printers, and facsimile devices is shown in FIG. 1. This sheet feeding device is provided with a feed roller 1 for conveying a paper 2 and a separating pad 3 opposing the feed roller 1 such that the paper 2 is interposed between the feed roller 1 and separating pad 3. This sheet feeding device is well known in the art for separating and conveying each of a stack of paper 2 one sheet at a time. The separating pad 3 shown in FIG. 1 is embedded into a depression formed in a sheet receiving portion 5 of a separating pad holder 4. The separating pad holder 4 is urged toward the feed roller 1 by a spring 7 interposed between a fixed stop member 6 and the bottom surface of the sheet receiving portion 5. The feed roller 1 is formed of an elastic material in an approximate D-shape and includes a circumferential surface 8 for contacting and conveying the paper 2 and a cut-out surface 9 formed by cutting away a portion of the circumferential surface 8. Rollers 10 are rotatably mounted on both ends of the feed roller 1. Both of the rollers 10 are formed with a radius slightly smaller than the radius of the circumferential surface 8. Hence, when the circumferential surface 8 is conveying the paper 2, the rollers 10 do not contact the paper 2. However, when the circumferential surface 8 has completed conveying the paper 2 and the cut-out surface 9 opposes the paper 2, the peripheral surface of the two rollers 10 contact the paper 2 and oppose the urging force of the separating pad 3, thereby forming a space between the cut-out surface 9 and the paper 2 to prevent the cut-out surface 9 from contacting the paper 2.

Guide rollers 12 and 13 are positioned downstream of the feed roller 1 and convey the paper 2 after the circumferential surface 8 has completed conveying the paper 2. The cut-out surface 9 is separated a prescribed distance from the paper 2 by the two rollers 10, thereby stopping driving of the paper 2. In addition, the rollers 10 contact and rotate on the top surface of the paper 2, which is conveyed by the guide rollers 12 and 13, thereby allowing only one paper 2 to be conveyed at a time.

However, when conveying the paper 2, the circumferential surface 8 and the rollers 10 contact the paper 2 and separating pad 3 at different positions, or heights, because the radius of the two rollers 10 is smaller than the radius of the circumferential surface 8. This difference in radii creates a bump when the paper 2 and separating pad 3 change from contacting the rollers 10 to contacting the circumferential surface 8 and vice versa, causing the separating pad 3 to move upward and downward.

When the separating pad 3 moves upward and downward, as described above, there is a tendency for a plurality of paper 2 to be fed simultaneously, causing doubles or partly overlapped sheets to be fed. In other words, when the paper 2 is first fed under the feed roller 1, the leading edge of the paper 2 contacts an entry contact portion 15 of the circumferential surface 8, which is the transition point from the rollers 10 contacting the separating pad 3 to the circumferential surface 8 contacting the separating pad 3. Therefore, the separating pad 3 is moved downward. In this instant, the pressure on the paper 2 changes greatly, inviting a plurality of paper 2 to enter simultaneously between the circumferential surface 8 and separating pad 3, inviting the feeding of doubles or multiple sheets. Also, when the circumferential surface 8 has completed conveying the paper 2, an exit contact portion 14 of the circumferential surface 8 is the last part of the feed roller 1 to contact the paper 2 before the roller 10 come in contact with the paper 2. In the instant that the paper 2 separates from the circumferential surface 8, the separating pad 3 moves upward, causing a great change in pressure on the paper 2, inviting the next paper 2 or plurality of next paper 2 to be conveyed along with the paper 2 being conveyed between the guide rollers 12 and 13, inviting the feeding of partly overlapped sheets. That is, immediately before stopping rotation of the sheet feed roller 1, the front part of the sheet reaches the guide rollers 12, 13, and the sheet is fed by the guide rollers 12,13. Further, the pressure from the separation pad 3 to the sheet is temporarily lowered when the paper 2 and separating pad 3 change from contacting the circumferential surface 8 of the feed roller 1 to contacting the rollers 10. In this case, the subsequent sheet may also be fed in accordance with the advancing movement of the precedent sheet due to the frictional force between the precedent sheet and a subsequent sheet.

SUMMARY OF THE INVENTION

In view of the foregoing, it is an object of the present invention to provide a sheet feeder capable of reliably feeding a recording medium one sheet at a time by a feed roller having a circumferential surface and a cut-out surface.

Another object of the present invention is to provide such sheet feeder capable of avoiding completely overlapped feeding or partly overlapping feeding of the papers.

These and other objects of the present invention will be achieved by providing a sheet feeder for feeding each sheet of recording medium including a feed roller, a separation pad, and a space forming member. The feed roller includes a roller mass having a circumferential surface portion for contacting and conveying the sheet of recording medium and a cut-out surface portion formed by cutting out a portion of the circumferential surface. The separating pad opposes the feed roller and is urged toward the feed roller for interposing the sheet between the separating pad and feed roller. The space forming member has a contact portion contacting the sheet and the separating pad for forming a space between the cut-out surface portion of the feed roller and the sheet and between the cut-out surface portion and the separating pad against urging force of the separating pad when the cut-out surface portion is in opposition to the sheet and the separation pad. The contact portion of the space forming member contacts the sheet, when the cut-out surface portion of the feed roller is opposite the sheet and the separating pad, at a level substantially the same as a level at which the circumferential surface portion of the feed roller contacts the sheet.

In another aspect of the invention, there is provided an image forming device including a casing, at least one cassette, a sheet feeder, a pair of guide rollers, an image forming unit, and a fixing unit. The casing has at least one cassette accommodating section. The at least one cassette maintains a stack of sheets and is detachably mounted on the at least one cassette accommodating section. The sheet feeder is provided immediately downstream of the at least one cassette. The sheet feeder includes the feed roller, the separating pad, and the space forming member. The pair of guide rollers are provided immediately downstream of the sheet feeder for conveying each sheet fed by the sheet feeder. The image forming unit is positioned downstream of the pair of guide rollers for forming a toner image on the sheet fed by the pair of guide rollers. The image forming unit includes a photosensitive drum and a transfer roller in confronting relation to the photosensitive drum. The fixing unit is positioned downstream of the image forming unit for fixing the toner image on the sheet fed from the image forming unit. The fixing unit includes a heat roller and a pressure roller in contact with the heat roller.

DETAILED DESCRIPTION OF THE PREFERRED EMBODIMENT

A sheet feeder according to a preferred embodiment of the present invention will be described while referring to FIGS. 3 through 10.

Figure 1:
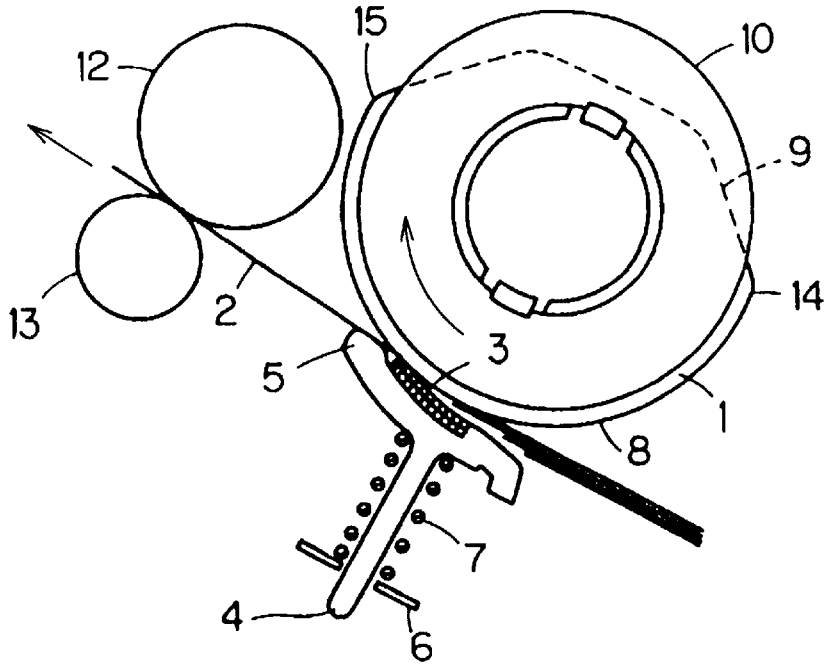
FIG. 1 PRIOR ART
FIG. 1 is a schematic view showing a conventional sheet feed device.
Figure 2:
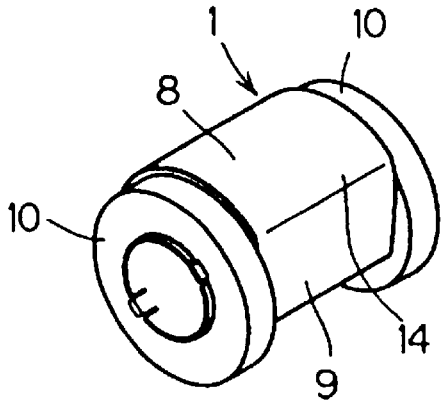
FIG. 2 PRIOR ART
FIG. 2 is a perspective view showing a sheet feed roller and a pair of rollers in the conventional device of FIG. 1.
Figure 3:
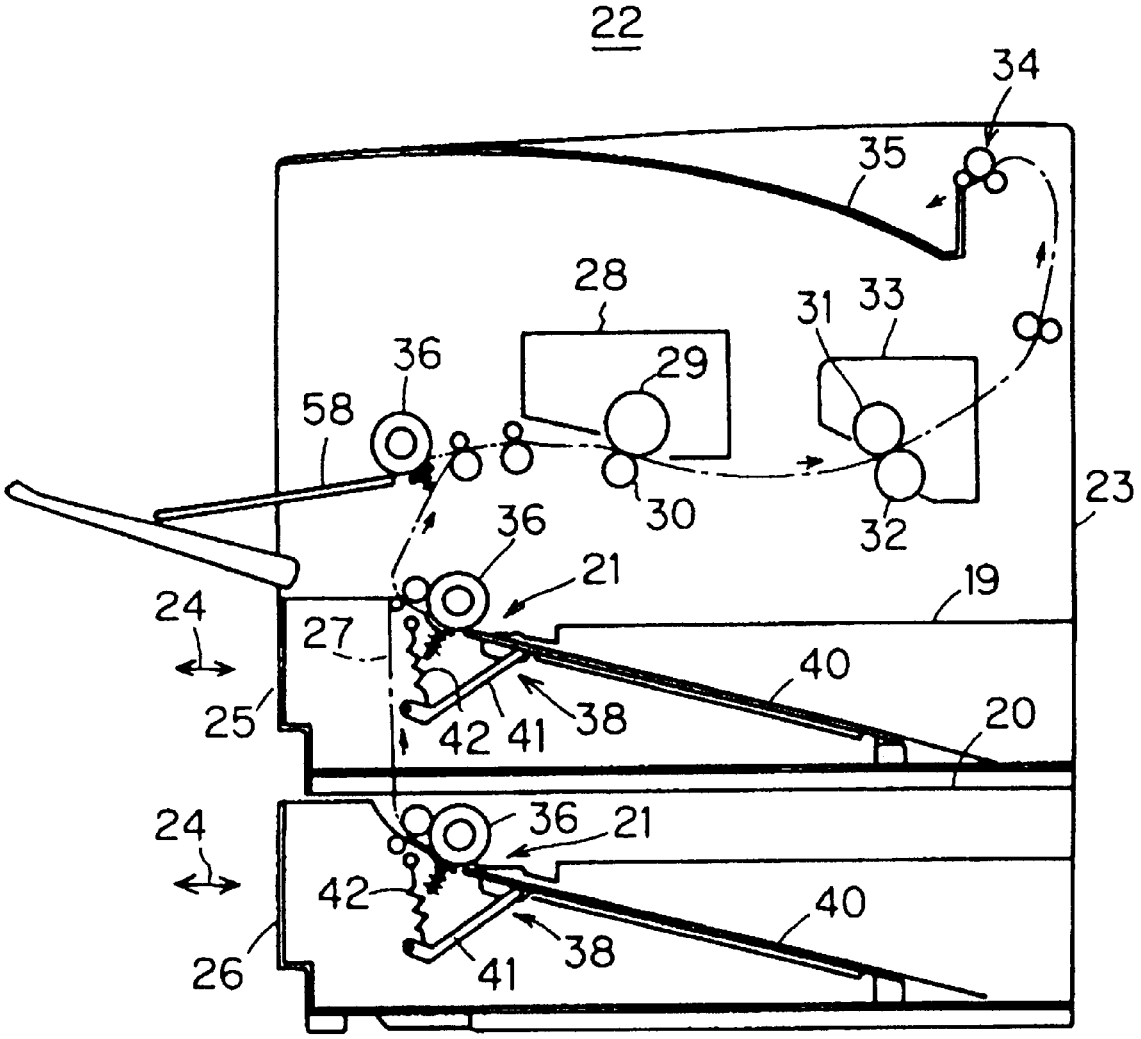
FIG. 3 is a side cross-sectional view showing relevant parts of a laser printer provided with a sheet feeder according to an embodiment of the present invention.

FIG. 3 shows a laser printer 22 provided with a sheet feeder according to the embodiment. The laser printer 22 includes a printer casing 23. The lower portion of the printer casing 23 is formed with a first cassette accommodating section 19 and a second cassette accommodating section 20. A first cassette 25 and a second cassette 26 are housed in the first cassette accommodating section 19 and second cassette accommodating section 20, respectively, for maintaining stacks of paper or overhead projector sheets 27. The first cassette 25 and second cassette 26 are capable of sliding freely in and out of the first cassette accommodating section 19 and second cassette accommodating section 20 in a direction indicated by arrows 24. The upper portion of the printer casing 23 is provided with an image forming unit 28 for forming a toner image and transferring the image to the sheet 27, and a fixing unit 33 for fixing a toner image on the sheet 27. The image forming unit 28 is provided with a toner cartridge, a charging device, and the like. The lower portion of the image forming unit 28 is provided with a photosensitive drum 29 and a transfer roller 30 in confronting relation to the photosensitive drum 29.

The fixing unit 33 is provided with a heating roller 31 and a pressure roller 32 in contact with the heating roller 31.

Each sheet 27 fed from either the first cassette 25 or the second cassette 26 is conveyed between the photosensitive drum 29 and transfer roller 30, at which time a toner image is transferred to the sheet 27. Subsequently, the sheet 27 is conveyed between the heating roller 31 and pressure roller 32, at which time the transferred toner image is fixed to the sheet 27. Finally, the sheet 27 is discharged by a discharge roller 34 onto a receiving tray 35.

Each of the first cassette 25 and second cassette 26 provided in the bottom section of the printer casing 23 is provided with a receiving plate 40 for receiving the stack of sheets 27. The bottom end of the receiving plate 40 (right side of the diagram) is rotatably supported near the bottom of the each cassette. The front end of the receiving plate 40 (left side of the diagram) is supported by a pivot arm 41. That is, a rear end of the pivot arm 41 is slidably movable with respect to the bottom surface of the front portion of the receiving plate 40. A front end of the pivot arm 41 is rotatably supported at a lower position on the frame of the cassette. An urging spring 42 is fixed between an upper portion on the frame of each cassette 25 (26) and the pivot arm 41, so that the pivot arm 41 is urged to be pivotally moved in a counterclockwise direction about the front pivot end of the pivot arm 41. Thus, the sheets 27 stacked on top of the receiving plate 40 are urged toward a feed roller 36 described later. The receiving plate 40, the pivot arm 41 and the urging spring 42 are all components of a sheet urging device 38.

The feed roller 36 and a separating pad 37 opposing the feed roller 36 are provided at the front end side of the receiving plate 40. With this configuration, a sheet 27 from a stack of sheets in either the first cassette 25 or second cassette 26 is interposed between the feed roller 36 and separating pad 37 (FIG. 7) and conveyed toward the image forming unit 28. The laser printer 22 also includes a manual insertion tray 58 for inserting a sheet of recording material by hand one sheet at a time. A combination of the feed roller 36 and the separating pad 37 is also provided at immediately downstream of the manual insertion tray 58.

Next, the process of feeding a sheet of paper using the feed roller 36 and the separating pad 37 will be described with reference to FIGS. 4–10.

Figure 4:
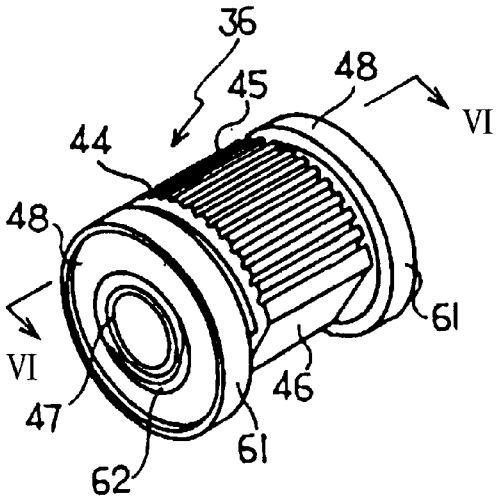
FIG. 4 is a perspective view showing a feed roller of the sheet feeder according to the embodiment of the present invention.
Figure 5:
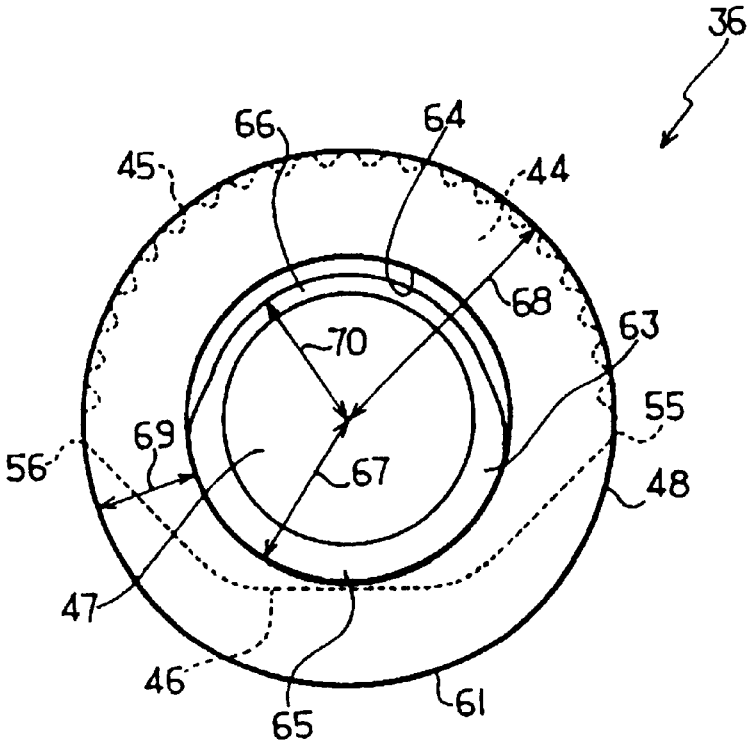
FIG. 5 is a side view showing the feed roller of FIG. 4.
Figure 6:
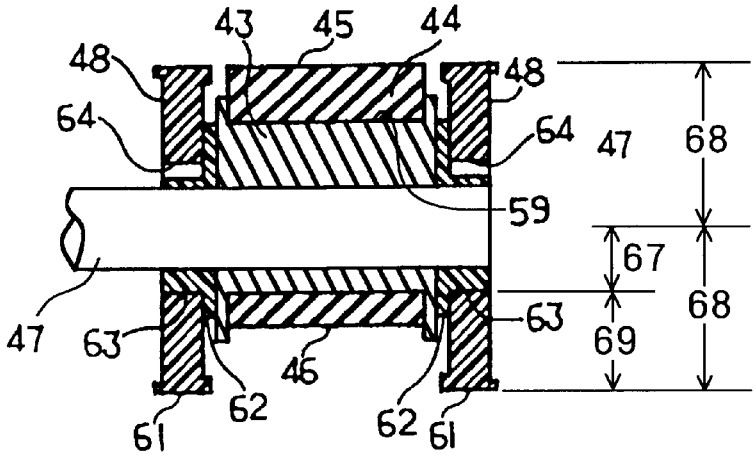
FIG. 6 is a cross-sectional view showing the feed roller taken along the line VI—VI of FIG. 4.

As shown in FIGS. 4, 5, and 6, the feed roller 36 includes a roller shaft 47, a core portion 43 composed of resin, and a surface portion 44 constructed of an elastic material such as rubber with a relatively high frictional coefficient. The roller shaft 47 extends through the core portion 43 and protrudes axially outwardly from each end of the core portion 43. The core portion 43 is fixed to the roller shaft 43. The surface portion 44 is formed over the core portion 43. The surface portion 44 is formed in an abbreviated cylindrical shape having a cross section shaped approximately like the letter D. The surface portion 44 has both a circumferential surface 45 for contacting and conveying the sheet 27 and a cut-out surface 46 formed by cutting away part of the circumferential surface 45. The circumferential surface 45 also includes a entry contact portion 55 for first contacting the sheet 27 during the feeding process and a exit contact portion 56 for last contacting the sheet 27. A plurality of grooves are formed in the circumferential surface 45 orthogonal to the conveying direction in order to prevent a slipping effect between the circumferential surface 45 and the sheet 27 during the conveying process. The core portion 43 has a peripheral surface 59 with a cross-section shaped approximately like the letter D. In addition, support shafts 62 are positioned beside the each end of the core portion 43 and is detachably fitted around the roller shaft 47.

Therefore, the feed roller 36 is constructed by fitting the surface portion 44 around the peripheral surface 59 of the core portion 43. Two rollers 48 are loosely fitted on the support shafts 62 and are capable of rotating on the support shafts 62. The rollers 48 are circularly shaped and formed with a cylindrical hollow space 64. The rollers 48 contact the sheet 27 and the separating pad 37 to prevent the cut-out surface 46 from contacting the same. Hence, the rollers 48 serves as a space forming member to form a gap between both the cut-out surface 46 and sheet 27 and the cut-out surface 46 and separating pad 37.

As shown in FIGS. 7 through 10, the separating pad 37 is disposed in a position opposing the feed roller 36, such that the sheet 27 is interposed between the feed roller 36 and the separating pad 37. This separating pad 37 is formed of an elastic material having a frictional coefficient slightly lower than that of the surface portion 44. A sheet receiving section 50 serves to support the separating pad 37. A depression is formed in the top surface of the sheet receiving section 50, allowing the separating pad 37 to be inset into the top surface of the sheet receiving section 50.

A separating pad urging device 39 is constructed beneath the feed roller 36 in each of the first cassette accommodating section 19 and second cassette accommodating section 20. The separating pad urging device 39 includes a separating pad holder 49 for supporting the sheet receiving section 50, a stop member 51 fixed at a position in the cassette accommodating section 19 and 20, and a spring 52 interposed between the bottom surface of the sheet receiving section 50 and the stop member 51 for urging the separating pad holder 49 toward the feed roller 36.

A guide roller 53 and guide roller 54 are disposed on the downstream side of the feed roller 36 for conveying the sheet 27 fed by the feed roller 36 toward the image forming unit 28. That is, the sheet 27 fed by the feed roller 36 enters between the guide roller 53 and guide roller 54. The guide rollers 53 and 54 are driven to rotate, thereby conveying the sheet 27 toward the image forming unit 28.

An irregular shaft portion 63 is provided on the support shaft 62 for permitting the peripheral surface 61 of the rollers 48 to be in contact with the sheet 27 at a radial position the same as the radial position at which the circumferential surface 45 of the feed roller 36 is in contact with the sheet 27, when the cut-out surface 46 is brought into opposition to the sheet 27 and separating pad 37. In other words, the irregular shaft portion 63 is provided for positioning the peripheral surface 61, which is the portion of the rollers 48 that contacts the sheet 27 and separating pad 37, in essentially the same radial position as the radial position in which the circumferential surface 45 contacts the sheet 27, when the cut-out surface 46 opposes the sheet 27 and separating pad 37. As shown in FIGS. 5 and 6, the irregular shaft portion 63 is formed on the support shaft 62 in order to contact the inner surface of the cylindrical hollow space 64 formed in the rollers 48. The irregular shaft member 63 includes a first radius portion 65 and a second radius portion 66 whose radius is slightly smaller than that of the first radius portion 65. The radius 67 of the first radius portion 65 is essentially equivalent to the difference between the radius 68 of the circumferential surface 45 and a radial distance 69 from the outer peripheral surface 61 of the rollers 48 to the inner peripheral surface of the hollow space 64. The first radius portion 65 is provided at an angular position the same as that of the cut-out surface 46, while the second radius portion 66 is provided at an angular position the same as that of the circumferential surface 45. Even if the support shaft 62 is provided detachable from the roller shaft 47, this angular positional relationship is maintained when the support shaft 62 is mounted over the roller shaft 47. In addition, the inner peripheral surface of the hollow space 64 of the two rollers 48 has a radius approximately equivalent to the radius of the first radius portion 65. When the first radius portion 65 is in contact with the inner peripheral surface of the hollow space 64, there is a gap between the second radius portion 66 and the inner peripheral surface of the hollow space 64 as shown in FIG. 6.

Figure 8:
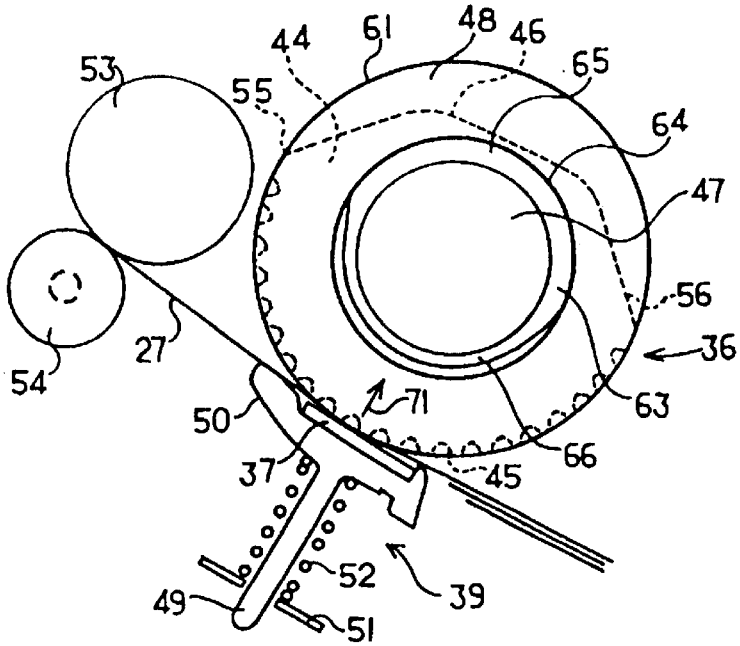
FIG. 8 is an explanatory drawing showing the state of the feed roller as the feed roller conveys the sheet of recording medium.

Accordingly, when the cut-out surface 46 opposes the sheet 27 and separating pad 37, the pressure from the separating pad 37 forces the first radius portion 65 to contact the inner peripheral surface of the hollow space 64. In this case, a length from an axial center of the roller shaft 47 to the outer peripheral surface 61 of the rollers 48 is approximately equal to the radius of the circumferential surface 45 as shown in FIGS. 5 and 8. Thus, the outer peripheral surface 61 of the rollers 48 can be in contact with the sheet 27 without any shock or bump at a transition timing from the contact between the circumferential portion 45 of the feed roller 36 and the sheet 27 to a contact between the outer peripheral surface 61 of the rollers 48 and the sheet 27.

On the other hand, when the circumferential surface 45 of the feed roller 36 is brought into confrontation with the sheet 27, the second radius portion 66 also brought into confrontation with the sheet 27 as shown in FIG. 8. In this case, the rollers 48 are suspendedly supported by the first radius portion 65. Further, in this case, since the second radius portion 66 has a smaller radius than the first radius portion 65, the rollers 48 can be freely moved upwardly by a gap distance between the inner peripheral surface of the hollow space 64 and the outer peripheral surface of the second radius portion 66. Therefore, the rollers 48 do not provide positive pressing force to the sheet 27. In other words, the length from the axial center of the roller shaft 47 to the outer peripheral surface 61 of the rollers 48 can be made shorter than the radius of the circumferential surface 45. Accordingly, when feeding sheets of paper with the circumferential surface 45, the sheet 27 will stay in contact with the circumferential surface 45.

The difference between the radius of the first radius portion 65 and the radius of the second radius portion 66 is greater than a radial deformation amount of the circumferential surface 45, the deforming direction being indicated by an arrow 71 in FIG. 8, which deformation is caused by pressure from the separating pad 37 on the circumferential surface 45. This will be described in detail later. The sheet feeder 21 is constructed with the above described feed roller 36, rollers 48, and separating pad 37. Thus, it is possible to reliably and accurately convey the sheet 27.

Next, the process of conveying the sheet 27 using this sheet feeder 21 will be described with reference to FIGS. 7 through 10.

Figure 7:
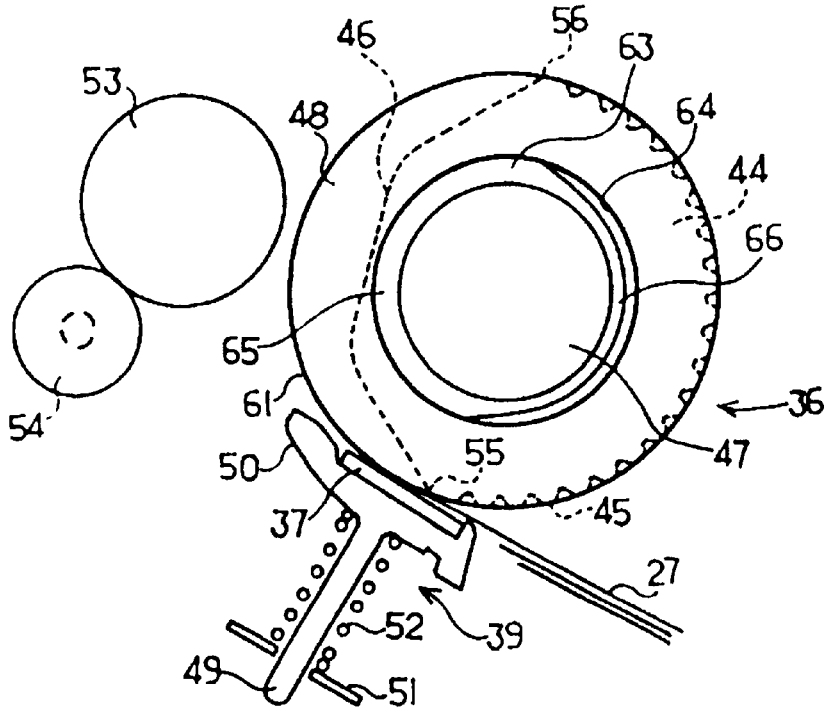
FIG. 7 is an explanatory drawing showing the state of the feed roller when a sheet of recording medium initially contacts the feed roller.

As shown in FIG. 7, the sheet 27 stacked in the first cassette 25 and second cassette 26 is positioned near the upstream side of the feed roller 36 via the sheet urging device 38 (FIG. 3). The sheet 27 is fed between the feed roller 36 and the separating pad 37 by the rotation of the feed roller 36.

As shown in FIG. 7, when the sheet 27 enters between the feed roller 36 and the separating pad 37, the sheet 27 contacts the entry contact portion 55 of the circumferential surface 45. Up to the moment the sheet 27 contacts the entry contact portion 55, the two rollers 48 continue to receive and oppose the pressure from the separating pad 37. However, from the moment the separating pad 37 contacts the entry contact portion 55, the entry contact portion 55 receives the pressure from the separating pad 37, and the sheet 27 is interposed between the entry contact portion 55 and the separating pad 37. At the same time, the first radius portion 65 is moved upwardly, so that the second radius portion 66 is moved downwardly. Thus, a gap is provided between the second radius portion 66 and the inner peripheral surface of the hollow space 64. Accordingly, the roller 48 is freely movable upwardly by the gap distance. Consequently, positive force from the roller 48 is not imparted to the sheet 27, but the sheet is pressed by the entry contact portion 55.

On the other hand, the distance from the axial center of the roller shaft 47 to the outer peripheral surface 61 of the rollers 48 is essentially the same as the radius of the circumferential surface 45 when the first radius portion 65 is positioned in confrontation with the sheet 27 and the separation pad 37. Therefore, the contact position of the outer peripheral surface 61 of the rollers 48 with the separating pad 37 is essentially the same as the contact position of the circumferential surface 45 with the sheet 27 and separating pad 37. Accordingly, during the transition from the state at which the rollers 48 contact the sheet 27 and separating pad 37 to the state in which the entry contact portion 55 comes in contact with the sheet 27 and separating pad 37, there is no bump caused by a difference in level. Hence, the separating pad 37 is not forced to move upward and downward. As a result, feeding of doubles that can be caused by upward and downward movement of the 37 can be prevented, allowing the sheet 27 to be fed one sheet at a time.

As shown in FIG. 8, the sheet 27 contacts the circumferential surface 45 of the feed roller 36 and is fed between the guide rollers 53 and 54. At this time, since the separating pad 37 applies pressure to the circumferential surface 45 by the spring 52 and since the circumferential surface 45 is made of the elastic material, the circumferential surface 45 is deformed inward in the direction indicated by the arrow 71. At the same time, the second radius portion 66 is opposite the separating pad 37, allowing the rollers 48 to move freely in the direction of the arrow 71 over a distance equal to the difference between the radius 67 and the radius 70. Still, the outer peripheral surface 61 remains in constant contact with the sheet 27 due to own weight of the roller 48. However, the rollers 48 do not apply any pressure to the sheet 27 and, therefore, do not obstruct the sheet conveying process. Since the difference between the radius 67 of the first radius portion 65 and the radius 70 of the second radius portion 66 is greater than the radially deforming amount of the circumferential surface 45 as described above, even when the pressure of the separating pad 37 causes the circumferential surface 45 to deform in the radial direction, the peripheral surfaces 61 of the rollers 48 will not apply pressure to the sheet 27. As a result, the sheet 27 can be reliably conveyed.

Figure 9:
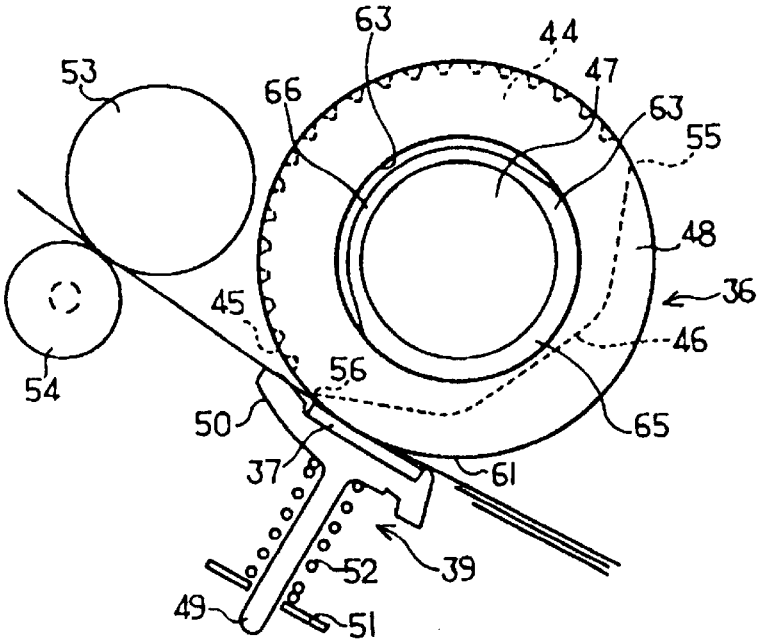
FIG. 9 is an explanatory drawing showing the state of the feed roller as the sheet of recording medium separates from the feed roller.

As shown in FIG. 9, at the moment the sheet 27 separates from the exit contact portion 56 of the feed roller 36, the pressure from the separating pad 37 that was received and opposed by the exit contact portion 56 begins to be received by the outer peripheral surfaces 61 of the rollers 48. However, at the same time, since the first radius portion 65 is brought into opposition to the separation pad 37, the inner peripheral surface of the hollow space 64 is made to contact the first radius portion 65 by pressure from the separating pad 37. Because the distance from the center of the roller shaft 47 to the outer peripheral surface 61 of the rollers 48 is essentially equal to the radius of the circumferential surface 45, the contact position of the circumferential surface 45 with the sheet 27 is essentially the same as the contact position of the outer peripheral surface 61 with the sheet 27 and separating pad 37. Accordingly, during the transition from the state at which the exit contact portion 56 contacts the sheet 27 and separating pad 37 to the state in which the rollers 48 contact the sheet 27 and separating pad 37, there is no bump caused by a difference in level. Hence, the separating pad 37 is not forced to move upward and downward. As a result, it is possible to eliminate feeding of a subsequent sheet partly overlapped with a preceding sheet.

Figure 10:
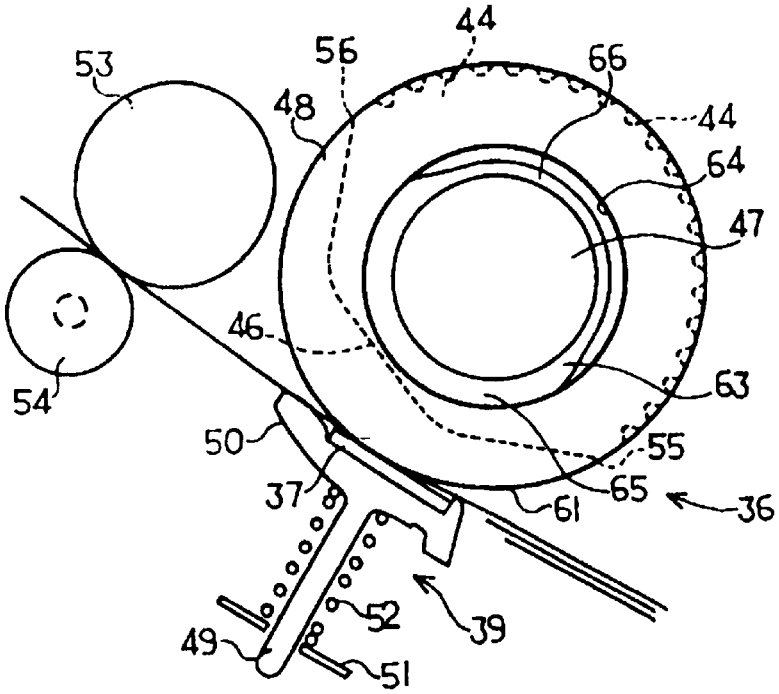
FIG. 10 is an explanatory drawing showing the state of the feed roller when conveyance of the sheet of recording medium is complete and the feed roller is waiting to convey a next sheet.

FIG. 10 shows the state in which the feed roller 36 has completed conveying one sheet of paper and is waiting to begin conveying the next sheet. As shown, the cut-out surface 46 is suspended in a position opposing but separated a prescribed distance from the separating pad 37. The sheet 27 fed by the feed roller 36 is now being conveyed toward the image forming unit 28 by the rotation of the guide rollers 53 and 54. Although the sheet 27 receives pressure from the separating pad 37 at this time, the top surface of the sheet 27 is contacted by the rotating peripheral surface 61 of the rollers 48. Therefore, a prescribed space can be maintained between the sheet 27 and the cut-out surface 46, and the sheet 27 can be reliably conveyed by the guide rollers 53 and 54.

As described above, when the sheet 27 enters beneath the feed roller 36 and when the sheet 27 separates from the feed roller 36, the separating pad 37 is not caused to move upward and downward, effectively preventing double sheets and partly overlapping sheets from being conveyed. Hence, the sheet 27 can be reliably conveyed one sheet at a time.

Further, by mounting the rollers 48 on the support shaft 62, which is coaxial with the roller shaft 47, the outer peripheral surface 61 of the rollers 48 can be easily and reliably positioned to contact the sheet 27 at essentially the same radial position as that in which the circumferential surface 45 contacts the sheet 27. In addition, by mounting the rollers 48 on both sides of the feed roller 36, a gap can be reliably formed between both the cut-out surface 46 and the sheet 27 and between the cut-out surface 46 and the separating pad 37 when the circumferential surface 45 has completed conveying the sheet 27 and the cut-out surface 46 opposes the sheet 27.

Figure 11:
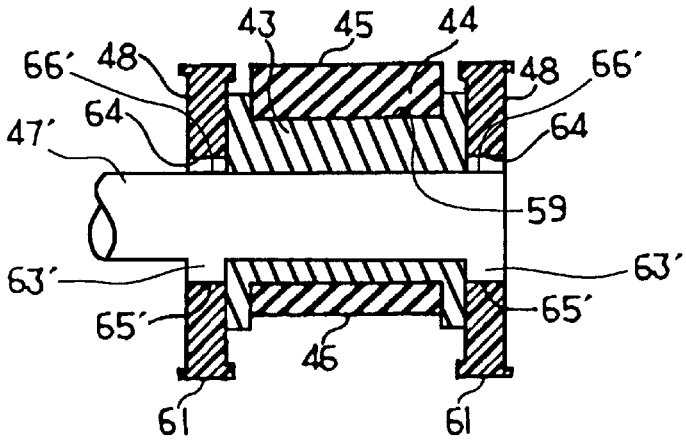
FIG. 11 is a cross-sectional view showing a feed roller according to a modified embodiment.

FIG. 11 shows a feed roller according to a modified embodiment. In the first embodiment, two rollers 48 are mounted on the irregular shaft portions 63 of the support shaft 62 which is detachably mounted on the roller shaft 47. However, it is also possible to provide the irregular shaft portions 63' directly on the roller shaft 47' and mount the two rollers 48 on the irregular shaft portion 63'. The irregular shaft portion 63' has a larger radius portion 65' and a smaller radius portion 66' corresponding to the first and second radius portions 65, 66, respectively of the first embodiment.

While the invention has been described in detail and with reference to the specific embodiment thereof, it would be apparent to those skilled in the art that various changes and modifications may be made therein without departing from the spirit and scope of the invention. For example, it is not particularly essential to use the two rollers 48, provided that the space forming member is capable of positioning the contact position of the outer peripheral surface 61 with the sheet at a position approximately the same as the contact position of the circumferential surface 45 with the sheet 27, when the cut-out surface 46 confronts the sheet 27 and the separation pad 37.

What is claimed is:

1. A sheet feeder for feeding each sheet of recording medium comprising:

a feed roller comprising a roller mass having an outer circumferential surface contactable with the sheet of recording medium at a predetermined rotational phase of the roller mass and out of contact from the sheet at a second rotational phase other than the predetermined rotational phase;

a separating pad opposing the feed roller and urged, by urging means for supplying an urging force, toward the feed roller for interposing the sheet between the separating pad and feed roller; and a space forming member having a contact portion contacting the sheet and the separating pad for forming a space between the circumferential surface of the roller mass and the sheet and between the circumferential surface and the separating pad against the urging force of the separating pad when the roller mass is in the second rotational phase, the contact portion of the space forming member contacting the sheet, when the roller mass is in the second rotational phase at a same level at which the roller mass is in the predetermined rotational phase.

2. The sheet feeder as claimed in claim 1, wherein the feed roller further comprises a roller shaft extending in an axial direction of the roller mass and protruding from the roller mass in the axial direction, the roller mass being rotatable about an axis of the roller shaft, the space forming member being provided rotatable over the roller shaft.

3. The sheet feeder as claimed in claim 2, wherein the roller shaft has a uniform diameter along its length, and further comprising a support shaft disposed over the roller shaft, the space forming member being provided rotatable over the support shaft.

4. The sheet feeder as claimed in claim 3, wherein a distance between the axis of the roller shaft and the contact portion of the space forming member contacting the sheet is substantially the same as a radius of the circumferential surface when the roller mass is in the second rotational phase.

5. The sheet feeder as claimed in claim 2, wherein the space forming member comprises a cylindrical member having a cylindrical hollow space therein, the sheet feeder further comprising a support shaft extending through the cylindrical hollow space.

6. The sheet feeder as claimed in claim 5, wherein the support shaft is provided with an irregular shaft portion around which the cylindrical hollow space is disposed, the irregular shaft portion being provided with a first radius portion having a first radius and a second radius portion having a second radius slightly smaller than the first radius, and the first radius of the first radius portion being equivalent to a difference between the radius of the circumferential surface when the roller mass is in the predetermined rotational phase and a distance from the contact portion of the space forming member to an inner peripheral surface which defines the hollow space.

7. The sheet feeder as claimed in claim 6, wherein the roller mass is made of an elastic material deformable in a radial direction thereof upon pressure from the separation pad, a difference between the first radius and the second radius being not less than the radial deformation amount of the roller mass.

8. The sheet feeder as claimed in claim 7, further comprising a biasing member connected to the separation pad for urging the separation pad toward the feed roller.

9. The sheet feeder as claimed in claim 6, wherein the first radius portion is provided at a first angular position identical with an angular position of the circumferential surface when the roller mass is in the second rotational phase, and wherein the second radius portion is provided at a second angular position identical with an angular position of the circumferential surface when the roller mass is in the predetermined rotational phase.

10. The sheet feeder as claimed in claim 2, wherein the roller shaft extends through the roller mass and protrudes from each end of the roller mass, and further comprising two support shafts provided around the roller shaft and positioned beside each end of the roller mass, the space forming member being rotatably provided at each support shaft.

11. The sheet feeder as claimed in claim 2, wherein the space forming member comprises a cylindrical member having a cylindrical hollow space therein, the roller shaft directly extending through the cylindrical hollow space.

12. The sheet feeder as claimed in claim 11, wherein the roller shaft is provided with an irregular shaft portion around which the cylindrical hollow space is disposed, the irregular shaft portion being provided with a first radius portion having a first radius and a second radius portion having a second radius slightly smaller than the first radius, and the first radius of the first radius portion being equivalent to a difference between the radius of the circumferential surface when the roller mass is in the predetermined rotational phase and a distance from a contact portion of the space forming member to an inner peripheral surface which defines the cylindrical hollow space.

13. The sheet feeder as claimed in claim 12, wherein the roller mass is made of an elastic material deformable in a radial direction thereof upon pressure from the separation pad, a difference between the first radius and the second radius being not less than the radial deformation amount of the roller mass.

14. The sheet feeder as claimed in claim 13, further comprising a biasing member connected to the separation pad for urging the separation pad toward the feed roller.

15. The sheet feeder as claimed in claim 12, wherein the first radius portion is provided at a first angular position identical with an angular position of the circumferential surface when the roller mass is in the second rotational phase, and wherein the second radius portion is provided at a second angular position identical with an angular position of the circumferential surface when the roller mass is in the predetermined rotational phase.

16. An image forming device comprising:

a casing having at least one cassette accommodating section;

at least one cassette maintaining a stack of sheets and detachably mounted on the at least one cassette accommodating section;

a sheet feeder provided immediately downstream of the at least one cassette, the sheet feeder comprising;

a feed roller comprising a roller mass having an outer circumferential surface contactable with a sheet from the stack of sheets of recording medium at a predetermined rotational phase of the roller mass and out of contact from the sheet at a second rotational phase other than the predetermined rotational phase;

a separating pad opposing the feed roller and urged, by urging means for supplying an urging force, toward the feed roller for interposing the sheet between the separating pad and feed roller; and a space forming member having a contact portion contacting the sheet and the separating pad for forming a space between the circumferential surface of the roller mass and the sheet and between the circumferential surface and the separating pad against the urging force of the separating pad when the roller mass is in the second rotational phase, the contact portion of the space forming member contacting the sheet, when the roller mass is in the second rotational phase, at a same level at which the roller mass is in the predetermined rotational phase;

a pair of guide rollers provided immediately downstream of the sheet feeder for conveying each sheet fed by the sheet feeder;

an image forming unit positioned downstream of the pair of guide rollers for forming a toner image on the sheet fed by the pair of guide rollers, the image forming unit comprising a photosensitive drum and a transfer roller in confronting relation to the photosensitive drum; and a fixing unit positioned downstream of the image forming unit for fixing the toner image on the sheet fed from the image forming unit, the fixing unit comprising a heat roller and a pressure roller in contact with the heat roller.

17. The image forming device as claimed in claim 16, further comprising;

a manual sheet insertion section provided between the pair of guide rollers and the image forming unit for manually inserting a sheet into the casing and toward the image forming unit; and another sheet feeder provided immediately downstream of the manual sheet insertion section, the another sheet feeder providing an arrangement identical with the sheet feeder.

18. The image forming device as claimed in claim 16, wherein the feed roller further comprises a roller shaft extending in an axial direction of the roller mass and protruding from the roller mass in the axial direction, the roller mass being rotatable about an axis of the roller shaft, the space forming member being provided rotatable over the roller shaft;

and the sheet feeder further comprising a support shaft disposed over the roller shaft, the space forming member being provided rotatable over the support shaft.

19. The image forming device as claimed in claim 18, wherein the space forming member comprises a cylindrical member having a cylindrical hollow space therein, the support shaft extending through the cylindrical hollow space;

and wherein the support shaft is provided with an irregular shaft portion around which the cylindrical hollow space is disposed, the irregular shaft portion being provided with a first radius portion having a first radius and a second radius portion having a second radius slightly smaller than the first radius, and the first radius of the first radius portion being equivalent to a difference between the radius of the circumferential surface when the roller mass is in the predetermined rotational phase and a distance from the contact portion of the space forming member to an inner peripheral surface which defines the cylindrical hollow space;

and wherein the first radius portion is provided at a first angular position identical with an angular position of the circumferential surface when the roller mass is in the second rotational phase;

and wherein the second radius portion is provided at a second angular position identical with an angular position of the circumferential surface when the roller mass is in the predetermined rotational phase.

20. The image forming device as claimed in claim 19, wherein the roller mass is made of an elastic material deformable in a radial direction thereof upon pressure from the separation pad, a difference between the first radius and the second radius being not less than the radial deformation amount of the roller mass.

21. A sheet feeder for feeding each sheet of recording medium, comprising:

a feed roller comprising a roller mass having an outer circumferential surface contactable with the sheet of recording medium at a predetermined rotational phase of the roller mass and out of contact from the sheet at a second rotational phase other than the predetermined rotational phase;

a separating pad opposing the feed roller and urged, by urging means for supplying an urging force, toward the feed roller for interposing the sheet between the separating pad and feed roller;

a space forming member having a cylindrical member having a cylindrical hollow space therein and a contact portion contacting the sheet and the separating pad for forming a space between the circumferential surface of the roller mass and the sheet and between the circumferential surface and the separating pad against the urging force of the separating pad when the roller mass is in the second rotational phase, the contact portion of the space forming member contacting the sheet, when the roller mass is in the second rotational phase at a level substantially the same as a level at which the roller mass is in the predetermined rotational phase;

a roller shaft extending in an axial direction of the roller mass and protruding from the roller mass in the axial direction, the roller mass being rotatable about an axis of the roller shaft, the space forming member being provided rotatable over the roller shaft; and a support shaft extending through the cylindrical hollow space, wherein the support shaft is provided with an irregular shaft portion around which the cylindrical hollow space is disposed, the irregular shaft portion being provided with a first radius portion having a first radius and a second radius portion having a second radius slightly smaller than the first radius, and the first radius of the first radius portion being equivalent to a difference between the radius of the circumferential surface when the roller mass is in the predetermined rotational phase and a distance from the contact portion of the space forming member to an inner peripheral surface which defines the hollow space.

22. An image forming device, comprising:

a casing having at least one cassette accommodating section;

at least one cassette maintaining a stack of sheets and detachably mounted on the at least one cassette accommodating section;

a sheet feeder provided immediately downstream of the at least one cassette, the sheet feeder comprising;

a feed roller comprising a roller mass having an outer circumferential surface contactable with a sheet from the stack of sheets of recording medium at a predetermined rotational phase of the roller mass and out of contact from the sheet at a second rotational phase other than the predetermined rotational phase;

a separating pad opposing the feed roller and urged, by urging means for supplying an urging force, toward the feed roller for interposing the sheet between the separating pad and feed roller; and a space forming member having a cylindrical member having a cylindrical hollow space therein and contact portion contacting the sheet and the separating pad for forming a space between the circumferential surface of the roller mass and the sheet and between the circumferential surface and the separating pad against the urging force of the separating pad when the roller mass is in the second rotational phase, the contact portion of the space forming member contacting the sheet, when the roller mass is in the second rotational phase, at a level substantially the same as a level at which the roller mass is in the predetermined rotational phase;

a roller shaft extending in an axial direction of the roller mass and protruding from the roller mass in the axial direction, the roller mass being rotatable about an axis of the roller shaft, the space forming member being provided rotatable over the roller shaft;

a support shaft extending through the cylindrical hollow space and disposed over the roller shaft, the space forming member being provided rotatable over the roller shaft, wherein the support shaft is provided with an irregular shaft portion around which the cylindrical hollow space is disposed, the irregular shaft portion being provided with a first radius portion having a first radius and a second radius portion having a second radius slightly smaller then the first radius, and the first radius of the first radius portion being equivalent to a difference between the radius of the circumferential surface when the roller mass is in the predetermined rotational phase and a distance from the contact portion of the space forming member to an inner peripheral surface which defines the hollow space;

a pair of guide rollers provided immediately downstream of the sheet feeder for conveying each sheet fed by the sheet feeder;

an image forming unit positioned downstream of the pair of guide rollers for forming a toner image on the sheet fed by the pair of guide rollers, the image forming unit comprising a photosensitive drum and a transfer roller in confronting relation to the photosensitive drum; and a fixing unit positioned downstream of the image forming unit for fixing the toner image on the sheet fed from the image forming unit, the fixing unit comprising a heat roller and a pressure roller in contact with the heat roller.

* * * * *